US010645762B2

(12) United States Patent
Elserman et al.

(10) Patent No.: US 10,645,762 B2
(45) Date of Patent: May 5, 2020

(54) INDUCTIVE NOZZLE HEATING ASSEMBLY

(71) Applicant: Ultimaker B.V., Utrecht (NL)

(72) Inventors: Martijn Elserman, Geldermalsen (NL); Johan Andreas Versteegh, Geldermalsen (NL); Erik van der Zalm, Eindhoven (NL)

(73) Assignee: Ultimaker B.V., Utrecht (NL)

( * ) Notice: Subject to any disclaimer, the term of this patent is extended or adjusted under 35 U.S.C. 154(b) by 625 days.

(21) Appl. No.: 15/278,052

(22) Filed: Sep. 28, 2016

(65) Prior Publication Data

US 2017/0094726 A1 Mar. 30, 2017

(30) Foreign Application Priority Data

Sep. 28, 2015 (NL) ..... 2015512

(51) Int. Cl.

*H05B 6/06* (2006.01)
*H05B 6/14* (2006.01)
*H05B 6/10* (2006.01)
*H05B 6/36* (2006.01)

(52) U.S. Cl.

CPC ..... *H05B 6/06* (2013.01); *H05B 6/10* (2013.01); *H05B 6/14* (2013.01); *H05B 6/36* (2013.01); *H05B 2206/023* (2013.01)

(58) Field of Classification Search

CPC ... H05B 6/06; H05B 6/14; H05B 6/36; H05B 2206/023
USPC ..... 219/600, 634, 644
See application file for complete search history.

(56) References Cited

U.S. PATENT DOCUMENTS 2,673,121 A * 3/1954 Brennan ..... B05B 7/18 219/629
2,810,168 A * 10/1957 Nyborg ..... B23K 3/0615 219/230
2,875,311 A * 2/1959 Harkenrider ..... B29C 48/832 219/618
3,014,255 A * 12/1961 Muller ..... C21C 7/10 164/258
3,521,325 A * 7/1970 Heinz ..... B29C 48/865 425/3
4,317,529 A * 3/1982 Leibhard ..... B05C 17/00526 222/146.5
4,816,228 A * 3/1989 Yoshida ..... C03B 5/021 219/635

(Continued)

FOREIGN PATENT DOCUMENTS

EP 2 842 724 3/2015

*Primary Examiner* — Jimmy Chou
(74) *Attorney, Agent, or Firm* — N.V. Nederlandsch Octrooibureau; Catherine A. Schultz; Tamara C. Stegmann

(57) ABSTRACT

An inductive nozzle heating assembly for an additive manufacturing system, comprises a rod shaped nozzle body of electrically conductive material provided with a passageway extending from an inlet end to an outlet end of the rod shaped nozzle body for dispensing an extrudable material. An induction coil unit is provided for magnetic engagement with the rod shaped nozzle body to allow heating thereof, wherein the induction coil unit encloses at least in part the rod shaped nozzle body. The induction coil unit and rod shaped nozzle body are spaced apart and separated by a minimum distance (Lg) larger than zero, and the rod shaped nozzle body comprises a heating piece having a predetermined Curie temperature.

17 Claims, 4 Drawing Sheets

(56) References Cited

U.S. PATENT DOCUMENTS 4,822,971 A * 4/1989 Peterson ..... B23K 1/002 219/610
4,962,291 A * 10/1990 Fujita ..... B22F 9/082 219/602
5,004,153 A * 4/1991 Sawyer ..... B22D 23/003 164/46
5,207,371 A * 5/1993 Prinz ..... B22F 3/008 164/46
6,130,397 A * 10/2000 Arai ..... H05H 1/30 219/121.37
6,230,936 B1 * 5/2001 Lasko ..... B05C 17/0053 219/426
6,304,590 B1 * 10/2001 Roberts ..... B21C 37/042 219/605
6,717,118 B2 * 4/2004 Pilavdzic ..... B29C 45/74 219/601
9,327,453 B2 * 5/2016 Mark ..... B29C 70/20
2003/0000945 A1 * 1/2003 Pilavdzic ..... H05B 6/14 219/628
2003/0121908 A1 7/2003 Pilavdzic et al.
2006/0153275 A1 * 7/2006 Ishikawa ..... G01J 5/0022 374/141
2008/0296277 A1 * 12/2008 McAninch ..... B23K 9/1093 219/136
2009/0014439 A1 * 1/2009 Kim ..... B29C 45/2737 219/634
2012/0231225 A1 * 9/2012 Mikulak ..... D01F 8/04 428/172
2013/0248515 A1 * 9/2013 Hunt ..... F24H 3/0423 219/600
2014/0159284 A1 * 6/2014 Leavitt ..... H05B 3/42 264/401
2014/0265037 A1 * 9/2014 Stirling ..... H05B 6/06 264/403
2014/0287139 A1 * 9/2014 Farmer ..... B05D 3/002 427/212
2014/0328964 A1 * 11/2014 Mark ..... B29C 70/20 425/166
2014/0361460 A1 * 12/2014 Mark ..... B29C 70/521 264/248
2015/0140153 A1 * 5/2015 Stirling ..... H05B 6/14 425/174.8 R
2015/0165666 A1 * 6/2015 Butcher ..... D02G 3/22 428/373
2015/0183138 A1 * 7/2015 Duty ..... B29C 64/209 264/427
2015/0321418 A1 * 11/2015 Sterman ..... A43C 3/00 264/40.7
2016/0175936 A1 * 6/2016 Boulos ..... B01J 2/02 75/346
2017/0094726 A1 * 3/2017 Elserman ..... H05B 6/06
2017/0151728 A1 * 6/2017 Kunc ..... B29C 64/209
2017/0239745 A1 * 8/2017 Zhai ..... B23K 9/1093
2017/0252817 A1 * 9/2017 Mykulowycz ..... B22F 3/115
2017/0361501 A1 * 12/2017 van der Zalm ..... B29C 64/112
2018/0108465 A1 * 4/2018 Takahashi ..... C22C 38/00
2018/0160486 A1 * 6/2018 Chiang ..... H05B 6/067
2018/0304369 A1 * 10/2018 Myerberg ..... B22F 3/115
2018/0311727 A1 * 11/2018 Willmann ..... B22F 3/1055
2019/0022961 A1 * 1/2019 Mourou ..... B33Y 10/00
2019/0099950 A1 * 4/2019 MacNeish, III ..... B29C 64/295

* cited by examiner

INDUCTIVE NOZZLE HEATING ASSEMBLY

FIELD OF THE INVENTION

The present invention relates to an inductive nozzle heating assembly, in particular to an inductive nozzle heating assembly for an additive manufacturing system. In a further aspect the present invention relates to a method of heating an inductive nozzle heating assembly.

BACKGROUND

US patent application US 2014/0265037 discloses a device for heating a feedstock of meltable or flowable material. The device comprises a heating body of electrically conductive material with one or more inlet orifices where the feedstock is introduced and one or more outlet orifices for said feedstock to exit after being heated. One or more passages or mixing chambers are provided that connect the inlet orifices and outlet orifices, comprising a nozzle. The nozzle body is sandwiched between two ends of, or inserted through a hole or gap in, a continuous or segmented core of material having high magnetic permeability but low electrical conductivity, forming a complete magnetic loop. One or more coils of electrically conductive wire pass through the center of the loop and around the outside of the loop. The device further comprises one or more sources of high frequency alternating current connected to the one or more coils. Eddy currents are induced by the magnetic field in the electrically conductive nozzle, which provide heating thereof. In an embodiment the continuous or segmented core is a torus shaped core.

US patent application US 2015/0140153 discloses an inductively heated extruder heater or adhesive dispenser using an electrically conductive nozzle with an inlet orifice and an outlet orifice connected by a passage. The nozzle is inserted into a gap or hole through a core formed in the shape of a loop or toroid, composed of soft magnetic material of high magnetic permeability and low electrical conductivity. A high-frequency alternating current is supplied to the coil, inducing a magnetic field in the magnetic core. The magnetic field, when passing through the electrically conductive nozzle, induces eddy currents that heat the nozzle to melt the material entering the inlet.

European patent application EP 2 842 724 discloses an induction heating system and a method for controlling a process temperature for induction heating of a workpiece. The induction heating system comprises an inductor configured to generate an alternating magnetic field in response to an alternating current supplied thereto. A magnetic load is provided comprising a magnetic material having a Curie temperature and being configured to generate heat in response to the alternating magnetic field being applied.

US patent application US 2003/0121908 discloses an apparatus for heating a flowable material. The apparatus comprises a core having a passageway formed therein for the communication of the flowable material, and an electric element coiled in multiple turns against the core in a helical pattern. The electric element, in use, heats the core both resistively and inductively.

SUMMARY

The present invention seeks to provide an improved inductive nozzle heating assembly for an additive manufacturing system allowing passive control of one or more heated zones within a nozzle body of the heating assembly for extruding a material. The inductive nozzle heating assembly allows one or more heating zones to be created within the nozzle body without active control of electromagnetic induction processes within the assembly. The inductive nozzle heating assembly further allows fast and easy exchangeability of the nozzle body for different materials and/or sizes.

According to an embodiment of the present invention, an inductive nozzle heating assembly of the type defined in the preamble is provided, comprising a rod shaped nozzle body of electrically conductive material provided with a passageway extending from an inlet end to an outlet end of the rod shaped nozzle body for dispensing an extrudable material; an induction coil unit for magnetic engagement with the rod shaped nozzle body to allow heating thereof, wherein the induction coil unit encloses at least in part the rod shaped nozzle body and wherein the induction coil unit and rod shaped nozzle body are spaced apart and separated by a minimum distance larger than zero, and wherein the rod shaped nozzle body comprises a heating piece having a predetermined Curie temperature, and wherein the inductive nozzle heating assembly further comprises a plurality of rod shaped nozzle bodies, each being movably arranged between a first and a second position with respect to the induction coil unit for magnetic engagement and magnetic disengagement, respectively, with the induction coil unit.

The inductive nozzle heating assembly of the present invention has the advantage that the rod shaped nozzle body does not require provisions to accommodate resistance wiring as heating is accomplished through an induction process instead. As a result the rod shaped nozzle body can be made smaller and lighter, thereby allowing for faster heating of the nozzle body as well as facilitating exchanging or swapping different rod shaped nozzle bodies for extruding material in an additive manufacturing process as there is no direct contact between the induction coil unit and the rod shaped nozzle body. Another advantage of the inductive nozzle heating assembly is that the predetermined Curie temperature of the heating piece allows convenient and safe temperature control within the rod shaped nozzle body without actively controlling the induction coil unit. A rise in temperature of the rod shaped nozzle body beyond the Curie temperature does not occur even when the induction coil unit remains operable and active at that temperature. This not only allows accurate control of a heating temperature to be attained within the rod shaped nozzle body during an additive manufacturing process, but the Curie temperature also provides inherent safety as excessive heating of the nozzle body cannot occur. Note that the rod shaped nozzle body comprises suitable material for which a Curie temperature exists, e.g. magnetic, ferromagnetic materials and the like. Finally, because the inductive nozzle heating assembly comprises a plurality of rod shaped nozzle bodies, multiple colour and/or extrusion materials for deposited layers can be used during an additive manufacturing process.

In an embodiment, the rod shaped nozzle body comprises a plurality of heating pieces each having a different predetermined Curie temperature. This embodiment offers the possibility for segmented heating wherein each of the plurality of heating pieces attains a different heating temperature when the induction coil unit is in operation. It is therefore possible to impose a temperature profile within the rod shaped nozzle body, wherein, for example, one or more heating pieces are responsible for preheating extrudable material and wherein one or more heating pieces are responsible for bringing the extrudable material to its final required temperature.

In a further embodiment, the plurality of heating pieces comprise or form a stacked arrangement along a longitudinal direction of the rod shaped nozzle body. This allows for different heating temperatures in longitudinal direction of the nozzle body so that a finely tuned heating process can be obtained when extrudable material traverses the nozzle body. In an exemplary embodiment each of the plurality of heating pieces is an annular heating piece, e.g. a ring-shaped heating piece. The stacked arrangement then comprises a stacked arrangement of annular heating pieces which, in part, form the passageway between the inlet end and outlet end of the nozzle body.

In an advantageous embodiment at least two heating pieces have different outer widths and/or lengths, which allows further temperature control of the nozzle body through different sizes of heating pieces. For example, enlarging a heating piece may increase its heat or thermal capacity, which influences the speed at which the heating pieces heat up when the induction coil unit is active. In this way the speed of heating may be controlled. In an embodiment, the induction coil unit comprises an inductive coil member enclosing at least in part the rod shaped nozzle body, wherein the inductive coil member is separated from the rod shaped nozzle body by at least the minimum distance (Lg). This embodiment allows for good inductive engagement between the rod shaped nozzle body for heating thereof, and wherein the rod shaped nozzle body may be easily placed or removed from the inductive nozzle heating assembly due to the at least partial enclosure of the rod shaped nozzle body by the inductive coil member.

SHORT DESCRIPTION OF DRAWINGS

The present invention will be discussed in more detail hereinafter based on a number of exemplary embodiments with reference to the drawings, in which FIG. 1 shows a side view of an embodiment of an inductive nozzle heating assembly according to the present invention;

FIG. 2 shows a side view of a further embodiment according to the present invention comprising a plurality of heating sections;

FIGS. 3 and 4 each show a cross section of a tubular core body made of soft magnetic material as used in present invention embodiments;

DETAILED DESCRIPTION

Figure 1:
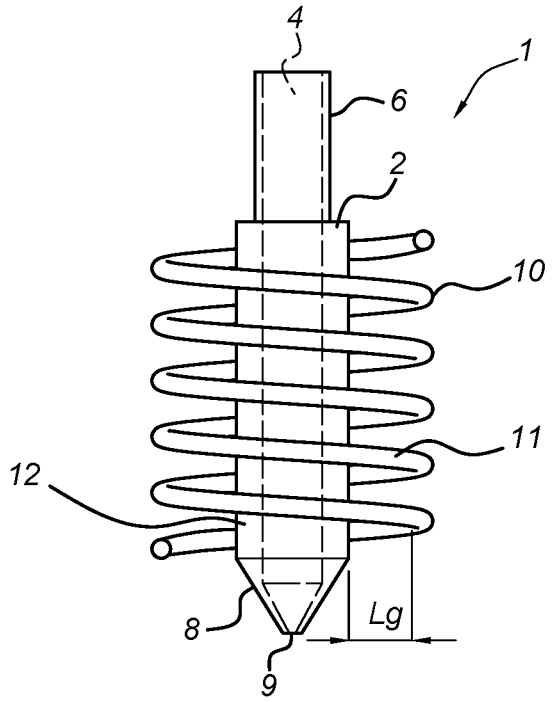

FIG. 1 shows a side view of an embodiment of an inductive nozzle heating assembly. In the embodiment shown, the assembly comprises a rod shaped nozzle body 2 of electrically conductive material provided with a passageway 4 extending from an inlet end 6 to an outlet end 8 of the rod shaped nozzle body 2 for dispensing an extrudable material. In most embodiments the outlet end 8 may comprise a nozzle tip 9, such as a tapered nozzle tip 9, from which the extrudable material is ejected. The extrudable material may be envisaged as a flowable material upon heating thereof, such as a thermoplastic filament or rod, which, when traversing through a heated nozzle body 2 becomes liquid and is subsequently extruded through the outlet end 8.

The inductive nozzle heating assembly further comprises an induction coil unit 10 for magnetic engagement with the nozzle body 2 to allow heating thereof during operation. The induction coil unit 10 encloses at least in part the nozzle body 2, wherein the induction coil unit 10 and nozzle body 2 are spaced apart and separated by a minimum distance (Lg) larger than zero. That is, the magnetic engagement between the nozzle body 2 and the induction coil unit 10 may be envisaged as a contactless engagement there between, merely comprising magnetic excitation of the nozzle body 2 through an "air gap".

The rod shaped nozzle body 2 further comprises a heating piece 12 having or exhibiting a predetermined Curie temperature, thereby allowing a predetermined maximum heating temperature to be attained within the heating piece 12 when the induction coil unit 10 is in magnetic engagement therewith.

During inductive heating of the nozzle body 2, in particular the heating piece 12, the Curie temperature determines when magnetic permeability drops and as a result inductive processes within the heating piece 12 drop. Even though the induction coil unit 10 may still be in operation, a rise in temperature of the heating piece 12 is stopped when the Curie temperature is reached. The Curie temperature of the heating piece 12 therefore defines a predetermined maximum heating temperature that can be attained beyond which no further temperature increase occurs. The Curie temperature thus allows "passive" or "parametric" temperature control of the nozzle body 2 by choosing a particular material for the heating piece 12 exhibiting the desired Curie temperature.

According to the invention, the heating of the nozzle body 2 is achieved through development of eddy currents and/or hysteresis losses within the nozzle body 2 during operation of the induction coil unit 10. The use of resistance wiring often found in prior art nozzle heating assemblies has therefore been circumvented and as such the rod shaped nozzle body 2 of the present invention can be smaller and lighter than previously possible.

The inductive nozzle heating assembly 1 is suitable for use in, e.g., an additive manufacturing system to print or deposit 3D objects in a layer by layer fashion, wherein one or more layers or even parts of a particular layer need not be extruded through the same nozzle body 2. The inductive nozzle heating assembly 1 of the present invention allows fast swapping of different nozzle bodies having different sizes and/or materials as there are no resistance wiring to be (dis)connected. Quickly swapping or exchanging nozzle bodies may be desirable as particular deposited layers of extruded material may require a different thickness, width and/or other mechanical properties not readily provided by a single nozzle body 2. Furthermore, a small fraction of extrusion material often remains in the nozzle body 2 when, e.g., the extrusion process pauses or a layer is finished. Swapping nozzle bodies may then be required when a different extrusion material is needed. That is, cleaning the nozzle body 2 is not needed and contactless engagement between the rod shaped nozzle body 2 and the induction coil unit 10 allows fast exchanging a nozzle body 2 for another one for extruding a layer or a part of a layer using a different material, e.g. a material having a different colour, strength, hardness etc.

In some embodiments, the rod shaped nozzle body 2 and/or the heating piece 12 may be made of a metallic material, such as a particular alloy, having a predetermined Curie temperature. During heating of the nozzle body 2 the Curie temperature determines when magnetic permeability drops and, as a result, inductive processes within the nozzle body 2 and/or heating piece 12 drop, effectively stopping the rise in temperature of the nozzle body 2. The Curie temperature allows passive or "parametric" temperature control of the nozzle body 2 by choosing a particular material thereof exhibiting the desired Curie temperature.

Here "parametric" temperature control should be construed as control by means of a physical property such as the Curie temperature of the nozzle body 2, by and large independent of magnetic field intensities or frequencies utilized for the inductive process. The Curie temperature can thus be chosen to match a desired extrusion temperature for a particular material to be extruded, without actively steering magnetic field intensities and frequencies to attain the desired extrusion temperature. Controlling the temperature within the nozzle body 2 is then a matter of choosing a suitable material for the nozzle body 2 exhibiting a particular Curie temperature.

In light of the above, in an embodiment, the induction coil unit 10 may be connected to an alternating current source comprising a current frequency and current amplitude during operation. The current frequency and current amplitude may or may not be set at constant values and are used for one or more nozzle bodies 2, wherein each nozzle body 2 exhibits a different Curie temperature. By simply swapping a nozzle body 2 for another nozzle body 2, a different extrusion temperature may be attained for the newly placed nozzle body 2 even though the magnetic field strength and frequency are maintained at constant values for the inductive process.

From a safety point of view, utilizing the Curie temperature of the nozzle body 2 also provides inherent safety, i.e. the nozzle body 2 cannot attain a higher temperature beyond the Curie temperature with continuing magnetic engagement between the induction coil unit 10 and the rod shaped nozzle body 2.

As further depicted in FIG. 1, in an embodiment the induction coil unit 10 may comprise an inductive coil member 11 enclosing at least in part the rod shaped nozzle body 2, wherein the inductive coil member 11 is separated from the rod shaped nozzle body 2 by at least the minimum distance (Lg). This embodiment allows for easy placement and removal of the nozzle body 2 from the inductive nozzle heating assembly 1 as there is no direct contact between the induction coil unit 10, in particular the inductive coil member 11. Consequently, there is no need to connect or disconnect the nozzle body 2 from any sort of heating wiring as such, making the nozzle body 2 easily swappable. In an embodiment, the minimum distance (Lg) lies between 0.5 mm and 5 mm, so as to obtain sufficient clearance for placement and removal of the nozzle body 2 and to ensure sufficient inductive engagement between the heating piece 12 and the induction coil unit 10.

In an embodiment, the induction coil unit 10 comprises an inductive coil member 11 wrapped around the rod shaped nozzle body 2 along a longitudinal axis thereof, wherein the inductive coil member 11 is separated from the rod shaped nozzle body 2 by at least the minimum distance (Lg). This embodiment allows the rod shaped nozzle body 2 to extend through the inductive coil member 11, which in many embodiments may be envisaged as a helical shaped coil member 11. In actual practise, the nozzle body 2 may be inserted with the inlet end 6 or the outlet end 8 first, depending on the application. For example, installing a nozzle body 2 may be accomplished by first inserting the inlet end 6 of the nozzle body 2, wherein the nozzle body 2 at some insertion length connects to a feeder unit providing the extrusion material to the nozzle body 2 during operation of the inductive nozzle heating assembly 1.

Figure 2:
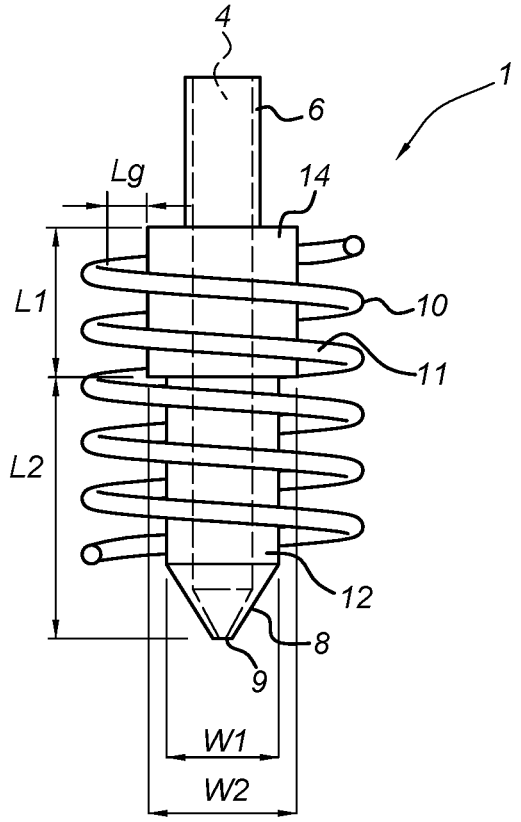

FIG. 2 shows a side view of a further embodiment comprising a plurality of heating sections. In this embodiment, the rod shaped nozzle body 2 may comprise a plurality of heating pieces 12, 14 each having a different Curie temperature. In typical embodiments, each heating piece 12, 14 is of a metallic material. The plurality of heating pieces 12, 13 allow for passive control of two or more sections of the nozzle body 2, wherein each of the heating sections 12, 14 may have a different Curie temperature and as such induce different extrusion temperatures of the heating section 12, 14 when the induction coil unit 10 is in magnetic engagement with the nozzle body 2. This embodiment can be advantageous as in particular extrusion scenarios it may be required to, for example, preheat the extrusion material entering the nozzle body 2 during the extrusion process. In such a case an upper heating section 14 may exhibit a relatively low Curie temperature just for preheating purposes, whereas a lower heating section 12 may exhibit a higher Curie temperature to achieve the correct extrusion temperature for the extrusion material being used.

In the further embodiment as depicted in the side view of FIG. 2, the plurality of heating pieces 12, 14 may comprise a stacked arrangement along a longitudinal direction of the rod shaped nozzle body 2. This embodiment allows segmented temperature control in longitudinal direction of the nozzle body 2 by a longitudinal arrangement of a plurality of heating pieces, wherein one or more heating pieces may have a different Curie temperature. In an embodiment, each of the plurality of heating pieces 12, 14 may comprise an annular heating piece, e.g. an annular disc shaped heating piece, wherein a stacked arrangement of such annular heating pieces provides a longitudinal heating profile when the induction coil unit 10 is in magnetic engagement with the rod shaped nozzle body 2. Detailed control of the longitudinal heating profile through the stacked arrangement of heating pieces 12, 14 allows for specific heating requirements of extrusion material and its flow behaviour as it traverses through the nozzle body 2.

In the further embodiment as depicted in FIG. 2, at least two heating pieces 12 14 may comprise a different outer width w1, w2 and/or length l1, l2. This embodiment provides further parametric temperature control in addition to temperature control through Curie temperatures of nozzle material. That is, dimensional properties of each of the heating sections 12, 14 may be arranged to influence heating properties such as heat capacity, which may determine the time needed to heat or cool down a heating section 12, 14 to a particular temperature when the nozzle body 2 is in magnetic engagement with the induction coil unit 10.

Figure 3:
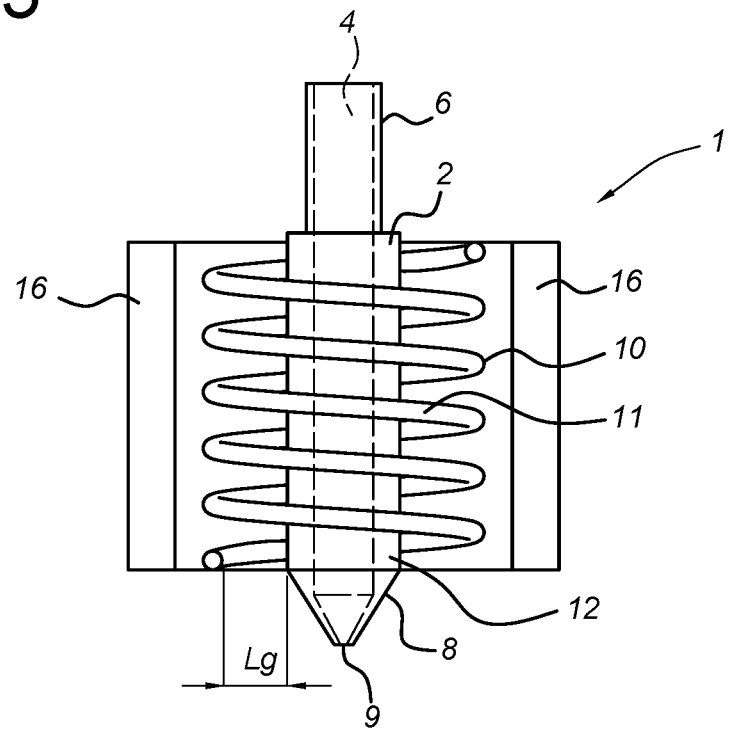
Figure 4:
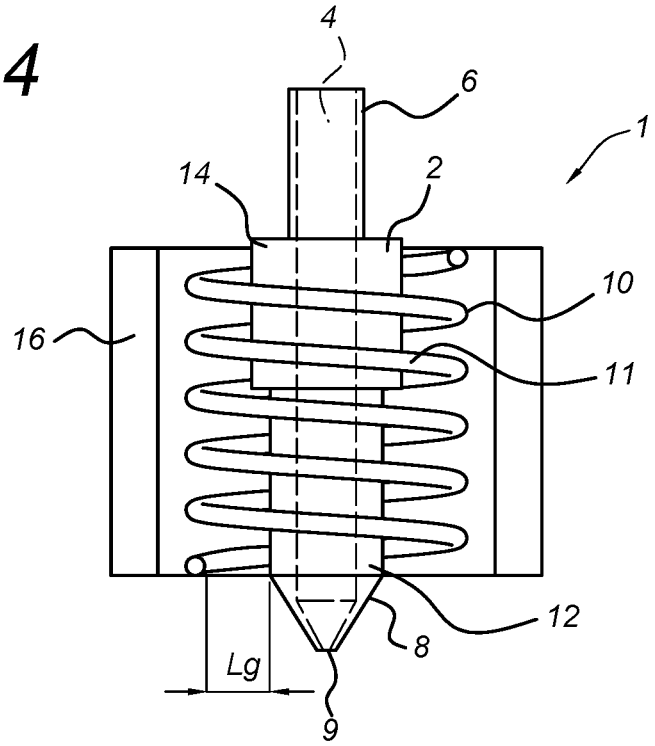

FIGS. 3 and 4 each show a cross section of an embodiment of a tubular core body 16 made of soft magnetic material. In the embodiment shown, the induction coil unit 10, in particular the inductive coil member 11, extends through a tubular core body 16. The tubular core body 6 provides a concentrated magnetic flux through the rod shaped nozzle body 2, thereby increasing induction efficiency within the nozzle body 2. The tubular core body 16 may comprise a soft metallic material to further improve flux concentration. As depicted in FIG. 4, the rod shaped nozzle body 2 extending through the tubular core body 16 may also comprise the one or more heating sections 12, 14. During operation of the induction coil unit 10 the concentrated magnetic flux extending through the core body 16 will also improve induction efficiency of the one or more heating sections 12, 14, allowing an efficient use of the different Curie temperatures between the one or more heating sections 12, 14 and thus control of the temperature thereof.

Figure 5:
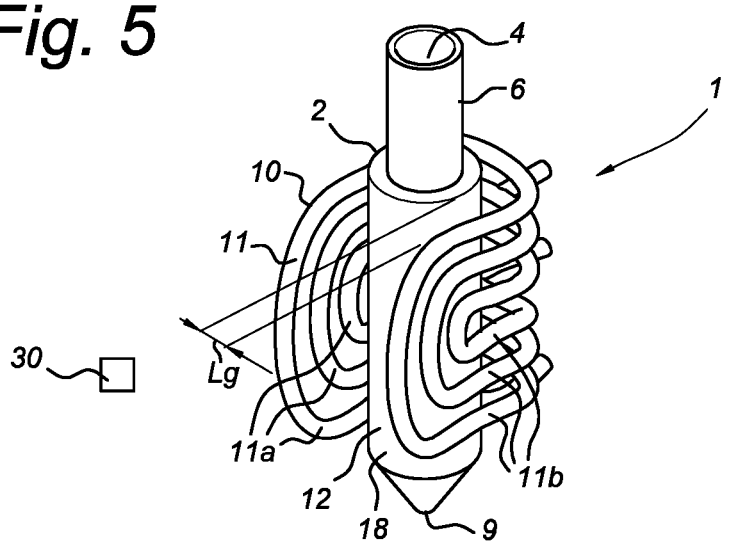
FIG. 5 shows a top view of a further embodiment having a folded inductive coil member.

FIG. 5 shows a top view of a further embodiment having a folded inductive coil member. In the embodiment shown, the induction coil unit 10 comprises a folded magnetic coil member 11 comprising one of more folds 11*a* and one or more folded coil sections 11*b* arranged around the rod shaped nozzle body 2. Because the magnetic coil member 11 is folded at least in part around the rod shaped nozzle body 2 in longitudinal direction, this embodiment allows for convenient placement and removal of the rod shaped nozzle body 2, yet provides relatively uniform inductive coupling and heating in longitudinal direction thereof. As with all other embodiments, the induction coil unit 10, in particular the folded magnetic coil member 11, encloses at least in part the rod shaped nozzle body 2, wherein said folded magnetic coil member 11 and rod shaped nozzle body 2 are spaced apart and separated by the minimum distance Lg larger than zero. In an embodiment, the folded magnetic coil member 11 may circumferentially enclose the rod shaped nozzle body 2 over 180° degrees as depicted, e.g. in a semicircular arrangement when viewed in longitudinal direction. However, depending on available or desired space requirements, in alternative embodiments the folded magnetic coil member 11 may circumferentially enclose the nozzle body 2 well over 180° degrees or even smaller than 180° degrees. As mentioned earlier, an advantage of this particular embodiment is that the rod shaped nozzle body 2 may be conveniently placed or removed in a sideways fashion, i.e. allowing placement or removal of the nozzle body 2 from a side of the inductive nozzle heating assembly 1.

Another advantage of the embodiment as shown in FIG. 5 is that the rod shaped nozzle body 2 is partially exposed over its longitudinal length, allowing easy access for e.g. a temperature sensor measuring temperatures of the rod shaped nozzle body 2 during operation. For example, the temperature sensor may be a contactless temperature sensor 30 having an unimpeded detection "view" by virtue of partial longitudinal exposure of the nozzle body 2. The temperature sensor may also be a direct contact thermocouple, which is readily attached to the nozzle body 2 as unimpeded access is provided due to the longitudinal exposure of the nozzle body 2. In further exemplary embodiments the temperature sensor may be a PT100 contact temperature sensor or an RTD contact temperature sensor.

Figure 6:
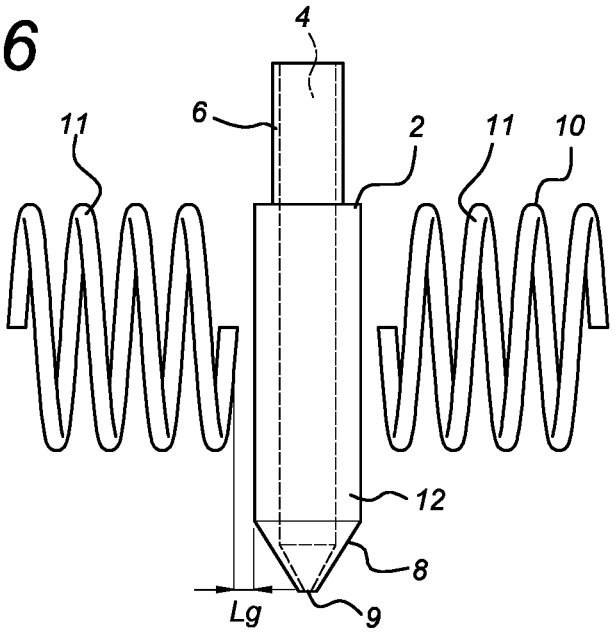
FIG. 6 shows a side view of an embodiment having a perpendicular positioned inductive coil member.

FIG. 6 shows a side view of an embodiment having a perpendicular positioned inductive coil member. In the embodiment shown, the induction coil unit 10 comprises an inductive coil member 11 arranged substantially perpendicular to the rod shaped nozzle body 2. The inductive coil member 11 is separated from the rod shaped nozzle body 2 by at least the minimum distance Lg. This embodiment allows for concentrated magnetic engagement between the induction coil unit member 11 and the rod shaped nozzle body 2 in longitudinal direction thereof. That is, magnetic excitation of the rod shaped nozzle body 2 during operation may be more localised in the lengthwise direction. As with the embodiment depicted in FIG. 5, this embodiment also allows convenient placement or removal of the rod shaped nozzle body 2 from a side of the inductive nozzle heating assembly 1.

Figure 7:
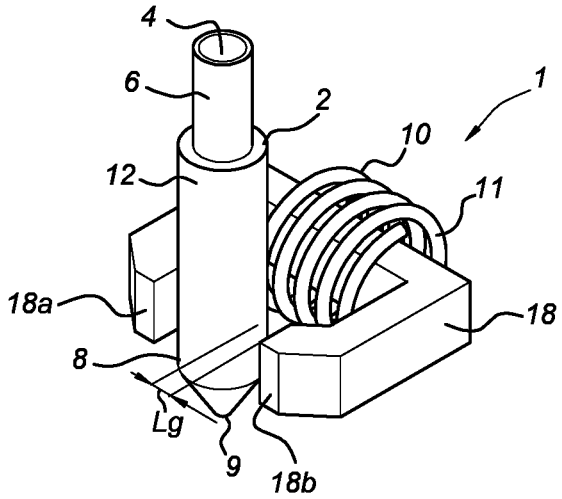
FIG. 7 shows a three dimensional view of a core body as used in an even further embodiment of the present invention.

FIG. 7 shows a three dimensional view of a core body made of soft magnetic material as used in an even further embodiment of to the present invention. In the embodiment shown, the induction coil unit 10 comprises an inductive coil member 11 wrapped around a core body 18 made of soft magnetic material having two opposing ends 18*a*, 18*b*, wherein the rod shaped nozzle body 2 is arranged between the two opposing ends 18*a*, 18*b*. Each opposing end 18*a*, 18*b* is separated from the rod shaped nozzle body 2 by at least the minimum distance Lg. The core body 18 allows for a localised and concentrated magnetic engagement between the opposing ends 18*a*, 18*b* and the rod shaped nozzle body 2. As depicted, the core body 18 extends through the inductive coil member 11 and concentrates magnetic flux within itself during operation. The opposing ends 18*a*, 18*b* provide concentrated magnetic excitation of a section of the rod shaped nozzle body 2 positioned between the opposing ends 18*a* 18*b*. The rod shaped nozzle body 2 may be placed or removed from a side of the induction coil unit 10, in particular the core body 18, allowing the nozzle body 2 to be replaced very quickly for applications that may require a plurality of nozzle bodies 12 during e.g. an additive manufacturing process.

Another advantage of this embodiment is that the localised magnetic engagement between the rod shaped nozzle body 2 and the induction coil unit 10 can be altered by relative displacement of the nozzle body 2 with respect to the induction coil unit 10. For example, in view of the depicted embodiment of FIG. 7, by moving the rod shaped nozzle body 2 in a longitudinal direction thereof with respect to the opposing ends 18*a*, 18*b*, another section of the nozzle body 2 can be heated. Furthermore, in an embodiment the rod shaped nozzle body 2 may comprise two or more longitudinally arranged heating sections 12, 14 as depicted in e.g. FIG. 2 or FIG. 4. The opposing ends 18*a* 18*b* then provided localised heating up to a desired temperature as defined by e.g. the associated Curie temperature of the actual heating section in magnetic engagement with the opposing ends 18*a*, 18*b*.

Figure 8:
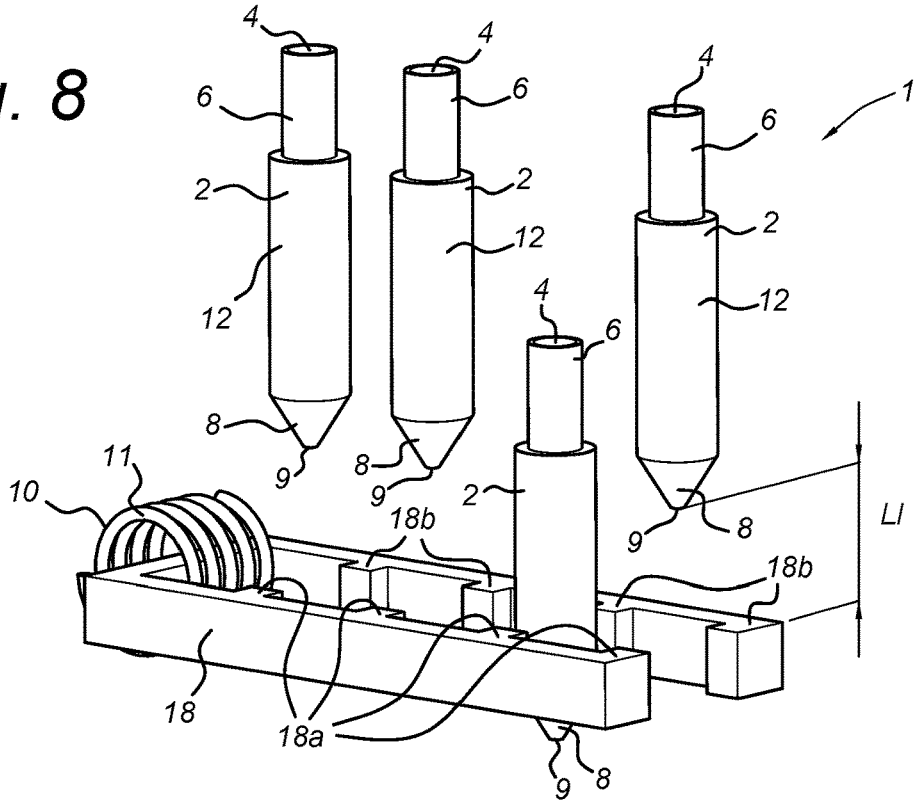
FIG. 8 shows a three dimensional view of an embodiment wherein a plurality of heating bodies are utilized.

FIG. 8 shows a three dimensional view of an embodiment wherein a plurality of heating bodies are utilized. In the embodiment shown, the inductive nozzle heating assembly 1 comprises a plurality of rod shaped nozzle bodies 2, each being movably arranged between a first and a second position with respect to the induction coil unit 10 for magnetic engagement and magnetic disengagement, respectively, with the induction coil unit 10. This embodiment may further comprise a core body 8 made of soft magnetic material, extending through the inductive coil member 11, and a plurality of opposing ends 18*a*, 18*b* each being arranged for magnetic excitation of an associated rod shaped heating rod 2. As with other embodiments, the induction coil unit 10, in particular each opposing end 18*a*, 18*b*, encloses at least in part each rod shaped nozzle body 2 in the first position, and wherein the induction coil unit 10 and each rod shaped nozzle body 2 are spaced apart and separated by a minimum distance Lg larger than zero. That is, in view of the depicted embodiment each rod shaped nozzle body 2 and associated opposing end 18*a*, 18*b* are separated by the minimum distance Lg. This embodiment is advantageous as a plurality of nozzle bodies 2 can be used for an additive manufacturing process requiring e.g. multiple colour and/or extrusion materials for deposited layers etc. By displacing a nozzle body 2 with respect to a pair of opposing ends 18*a*,

18*b*, can the nozzle body 2 be heated. In an embodiment, the distance between the first and second position may be some required disengagement distance L1 to ensure a rod shaped nozzle body 2 is not heated when moved to the second position (e.g. upper position as depicted).

According to the present invention, by utilizing the Curie temperature of a rod shaped nozzle body 2 it is possible to passively control the temperature thereof during magnetic engagement between the induction coil unit 10 and the nozzle body 2, wherein the inductive process stops when the nozzle body 2 reaches the Curie temperature. Furthermore, a nozzle body 2 comprising a plurality of heating sections 12, 14 of different material allows different operational temperatures of sections of the nozzle body 2 when subjected to the same magnetic field. In order to further control temperatures within a nozzle body 2 during operation, the nozzle body 2 may further utilize thermal barriers for reducing thermal conduction through the nozzle body 2.

Figure 9:
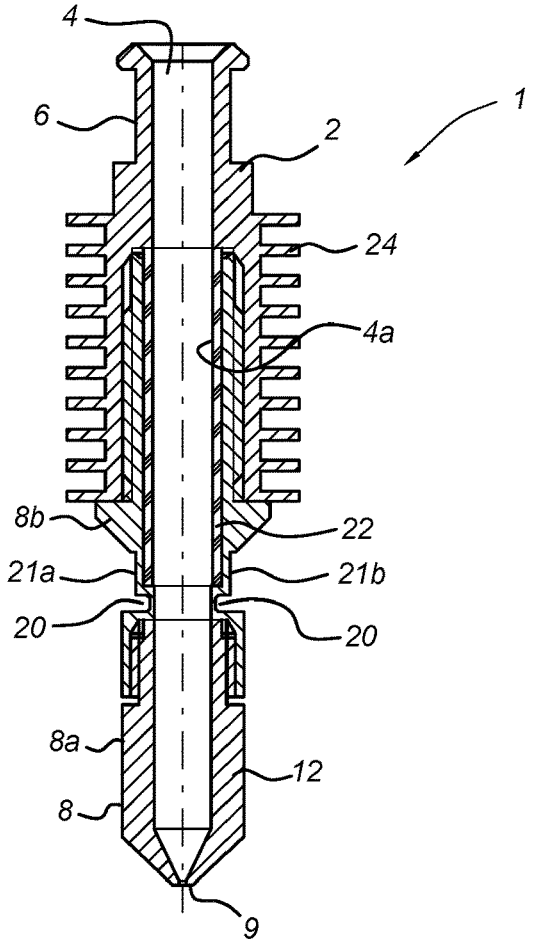
FIG. 9 shows a cross section of an even further embodiment of a rod shaped nozzle body provided with one or more heat barriers according to the present invention.

FIG. 9 shows a cross section of an even further embodiment of a rod shaped nozzle body provided with one or more thermal barriers. In the embodiment shown, the rod shaped nozzle body 2 comprises one or more circumferential portions 20 having a smallest wall thickness. The one or more circumferential portions 20 reduce thermal conduction between an upper section 8*a* and a lower section 8*a* of the outlet end 8. In an embodiment, the one or more circumferential portions 20 may comprise one or more circumferential grooves 21*a*, which provide a smallest wall thickness compared to adjacent parts of the one or more grooves 21. In other embodiments the one or more circumferential portions 20 may comprise one or more tubular sections 21*b* having a smallest wall thickness compared to adjacent parts of these tubular sections 21*b*.

In a further embodiment, the rod shaped nozzle body 2 comprises a coating or sleeve 22 arranged on an inner surface 4*a* of the passageway 4. The coating or sleeve 22 reduces thermal conduction between the inner surface 4*a* and other parts of the nozzle body 2. In an embodiment, the coating or sleeve 22 may comprise heat resistant Teflon®, such as Teflon® AF, which not only reduces adhesion of extrusion material to the nozzle body 2 when traversing there through, but due to its thermal resistance also reduces the risk of overheating of extrusion material when the nozzle body 2 becomes too hot during an inductive process in the nozzle body 2.

In further embodiments, the rod shaped nozzle body 2 may comprise a plurality of cooling ribs 24, which further preventing particular sections of the nozzle body 2 to overheat during inductive processes.

As disclosed so far, the present invention allows for a contactless engagement between the rod shaped nozzle body 2 and the induction coil unit 10 for transferring power from the induction coil unit 10 to the nozzle body 2. To maintain such a contactless engagement and to monitor temperatures of the nozzle body 2 during operation of the inductive nozzle heating assembly 1, one or more contactless thermal sensors may be provided that are in sensing engagement with the rod shaped nozzle body 2 during operation. This embodiment prevents physical contact with the nozzle body 2 to monitor temperature, allowing for convenient and fast placement and removal of a rod shaped nozzle body 2 as no sensor wiring needs to be (dis)connected. In an embodiment the inductive nozzle heating assembly 1 may comprise one or more infrared sensors for monitoring the temperature of one or more heating sections of the nozzle body 2, which are able to accurately monitor surface temperatures of the nozzle body 2.

In an alternative embodiment, the inductive nozzle heating assembly 1 may comprise one or more thermocouple devices connected to the rod shaped nozzle body 2, thereby providing direct physical contact with the nozzle body 2. Direct physical contact for temperature measurement may provide more robust and accurate temperature readings in applications where outer surfaces of the nozzle body 2 may become dirty during an additive manufacturing process for example.

In addition to the Curie temperature to passively control the temperature of the nozzle body 2 as outlined above, the use of thermal sensors may also allow for active temperature control of the nozzle body 2 as the temperature of one or more heating sections of the nozzle body 2 may be actively monitored. In particular, magnetic field intensity for heating the rod shaped nozzle body 2 may be changed based on thermal readings of one or more thermal sensors, such as one or more infrared sensors or thermocouple devices.

In a further aspect the present invention relates to a method of heating an inductive nozzle heating assembly 1, such as the one disclosed above. For example, in addition to passive control through the Curie temperature of a heating piece of an inductive nozzle heating assembly, active temperature control of the inductive nozzle heating assembly is also possible by measuring a change in magnetic permeability of the heating piece and acting upon the change in magnetic permeability thereof. For example, the inductive nozzle heating assembly 1 may be provided with a control unit and an electrical circuit connected thereto, such as an LC circuit. The electrical circuit may comprise the induction coil unit 10 or in particular the inductive coil member 11. When the inductive nozzle heating assembly 1 is in heating mode during magnetic engagement between the induction coil unit 10 and the rod shaped nozzle body 2, the electrical circuit may exhibit a measurable change in electrical resonance frequency when the magnetic permeability of the heating piece 12 changes due to a change in temperature thereof. The control unit may then be configured to measure or detect the change in electrical resonance frequency and to modify a frequency and/or an amplitude of magnetic engagement of the induction coil unit 10 with the rod shaped nozzle body 2 by controlling e.g. a current through the induction coil unit 10. This will then change the heating speed or heating intensity of the rod shaped nozzle body 2 to obtain a desired operating temperature thereof.

In light of the considerations above, the present invention therefore provides a method of heating an inductive nozzle heating assembly as disclosed above, comprising the steps of a) initiating magnetic engagement between the induction coil unit 10 and the heating piece 12 of the rod shaped nozzle body 2;

b) measuring a change in magnetic permeability of the heating piece 12 during magnetic engagement; and c) changing a frequency and/or an amplitude of the magnetic engagement in response to the change in magnetic permeability.

An advantage of the method according to the present invention is that active temperature control is possible without using one or more direct temperature sensors. By measuring magnetic properties of the heating piece 12, contactless engagement between the induction coil unit 10 and the rod shaped nozzle body 2 is maintained in light of convenient exchanging a rod shaped nozzle bodies 2 for example.

In an embodiment, the method step of d) measuring a change in magnetic permeability of the heating piece 12 may further comprise measuring a change in electrical resonance frequency of the inductive coil unit 10, e.g. the inductive coil member 11. This embodiment has the advantage that during magnetic engagement between the heating piece 12 and the induction coil unit 10, an electrical resonance frequency of the inductive coil unit 10 is readily measurable and so a change in electrical resonance frequency is measurable as a result of a change in temperature of the heating piece 12. Based on the measured change in electrical resonance frequency, a frequency and/or an amplitude of the magnetic engagement can be determined and imposed in order to achieve a particular operating temperature of the heating piece 12.

In particular, the method may comprise controlling a current through the induction coil unit 10 and measuring a corresponding electrical resonance frequency of the inductive coil unit 10. By controlling the current through the induction coil unit 10, and by measuring the corresponding electrical resonance frequency, it is possible to derive or correlate a corresponding temperature of the heating piece 12 associated with the measured electrical resonance frequency. An advantage of controlling and measuring the electrical resonance frequency for reaching a required nozzle temperature is that energy transfer between the heating piece 12 and the induction coil unit 10 is most efficient at the electrical resonance frequency.

To further explain the advantages of measuring a change in electrical resonance frequency of the inductive coil unit 10, after the method step of a) initiating magnetic engagement between the induction coil unit 10 and the heating piece 12 of the rod shaped nozzle body 2, the method may comprise a method step wherein the induction coil unit 10 is brought into oscillation until a stable oscillation is achieved. This stable oscillation may be associated with an electrical resonance frequency as outlined above. The method may then comprise changing a current frequency through the induction coil unit 10 until a desired current frequency is reached, i.e. the electrical resonance frequency, wherein the electrical resonance frequency correlates with a particular temperature of the heating piece 12. In this way an indirect temperature measurement of the heating piece 12 is performed and direct temperature measurement is not required.

The present invention embodiments have been described above with reference to a number of exemplary embodiments as shown in and described with reference to the drawings. Modifications and alternative implementations of some parts or elements are possible, and are included in the spirit and scope of protection, as defined in the appended claims.

The invention claimed is:

1. An inductive nozzle heating assembly for an additive manufacturing system, comprising:

a plurality of rod shaped nozzle bodies of electrically conductive material and wherein each nozzle body is provided with a passageway extending from an inlet end to an outlet end of the rod shaped nozzle body for dispensing an extrudable material;

wherein each of the plurality of rod shaped nozzle bodies comprises a heating piece, the heating piece having a predetermined Curie temperature;

an induction coil unit for magnetic engagement with the heating piece of each rod shaped nozzle body to allow heating thereof, wherein the induction coil unit comprises an inductive coil member wrapped around a core body made of soft magnetic material having two opposing ends, the core body extending through the induction coil member, wherein the rod shaped nozzle body is interposed between the two opposing ends, each opposing end being separated from the rod shaped nozzle body by at least the minimum distance, and wherein each nozzle body is movably arranged between an upward position and a downward position with respect to the induction coil unit for magnetic engagement and magnetic disengagement of the heating piece, respectively, with the induction coil unit.

2. The inductive nozzle heating assembly of claim 1, wherein each of the plurality of rod shaped nozzle bodies comprises a plurality of heating pieces each having a different predetermined Curie temperature.

3. The inductive nozzle heating assembly of claim 2, wherein the plurality of heating pieces comprise a stacked arrangement along a longitudinal direction of each of the plurality of rod shaped nozzle bodies.

4. The inductive nozzle heating assembly of claim 2, wherein at least two heating pieces have different outer widths and/or lengths.

5. The inductive nozzle heating assembly of claim 1, wherein the induction coil unit comprises the inductive coil member enclosing at least in part each of the plurality of rod shaped nozzle bodies, the inductive coil member being separated from each rod shaped nozzle body by at least the minimum distance.

6. The inductive nozzle heating assembly of claim 1, wherein the induction coil unit comprises the inductive coil member wrapped around each of the plurality of rod shaped nozzle bodies along a longitudinal axis thereof, the inductive coil member being separated from each of the plurality of rod shaped nozzle bodies by at least the minimum distance.

7. The inductive nozzle heating assembly of claim 1, wherein the induction coil unit comprises the inductive coil member arranged substantially perpendicular to each rod shaped nozzle body, the inductive coil member being separated from each of the plurality of rod shaped nozzle bodies by at least the minimum distance.

8. The inductive nozzle heating assembly of claim 6, wherein the inductive coil member extends through a tubular core body made of soft magnetic material.

9. The inductive nozzle heating assembly of claim 1, wherein each of the plurality of rod shaped nozzle bodies comprises one or more circumferential portions having a smallest wall thickness.

10. The inductive nozzle heating assembly of claim 1, wherein each of the plurality of rod shaped nozzle bodies comprises a coating or sleeve arranged on an inner surface of the passageway.

11. The inductive nozzle heating assembly of claim 1, wherein each of the plurality of rod shaped nozzle bodies further comprises a plurality of cooling ribs.

12. The inductive nozzle heating assembly of claim 1, further comprising one or more thermocouple devices connected to each of the plurality of rod shaped nozzle bodies.

13. The inductive nozzle heating assembly of claim 1, wherein the induction coil unit is connected to an alternating current source comprising a current frequency and current amplitude during operation.

14. A method of heating an inductive nozzle heating assembly, wherein the inductive nozzle heating assembly comprises providing a plurality of rod shaped nozzle bodies of electrically conductive material and wherein each nozzle body is provided with a passageway extending from an inlet end to an outlet end of the rod shaped nozzle body for dispensing an extrudable material;

wherein each of the plurality of rod shaped nozzle bodies comprises a heating piece, the heating piece having a predetermined Curie temperature providing an induction coil unit for magnetic engagement with the heating piece of each rod shaped nozzle body to allow heating thereof, wherein the induction coil unit comprises an inductive coil member wrapped around a core body made of soft magnetic material having two opposing ends, the core body extending through the induction coil member, wherein the rod shaped nozzle body is interposed between the two opposing ends, each opposing end being separated from the rod shaped nozzle body by at least the minimum distance, and wherein each nozzle body is movably arranged between an upward position and a downward position with respect to the induction coil unit for magnetic engagement and magnetic disengagement of the heating piece, respectively, with the induction coil unit, and wherein the method comprises the steps of a) initiating magnetic engagement between the induction coil unit and a heating piece of one of the rod shaped nozzle bodies;

b) measuring a change in magnetic permeability of the heating piece during magnetic engagement;

c) changing a frequency and/or an amplitude of the magnetic engagement in response to the change in magnetic permeability.

15. The method of claim 14, wherein the method step of b) measuring a change in magnetic permeability may further comprise measuring a change in an electrical resonance frequency of the inductive coil unit during magnetic engagement.

16. The inductive nozzle heating assembly of claim 1, wherein each heating piece is an annular heating piece.

17. The inductive nozzle of claim 2, wherein each heating piece is an annular heating piece.

* * * * *